United States Patent [19]

Bertram et al.

[11] Patent Number: 4,807,365

[45] Date of Patent: Feb. 28, 1989

[54] METHOD FOR MAKING THE SHAVING HEAD OF A DRY-SHAVING APPARATUS

[75] Inventors: Leo Bertram, Stolberg, Fed. Rep. of Germany; Hugo Schemmann, Schaesberg, Netherlands; Romuald L. Bukoschek, Klagenfurt; Reinhard Huszar, Strau, both of Austria

[73] Assignee: U.S. Philips Corp., New York, N.Y.

[21] Appl. No.: 4,934

[22] Filed: Jan. 20, 1987

[30] Foreign Application Priority Data

Jan. 17, 1986 [DE] Fed. Rep. of Germany ..... 3601202

[51] Int. Cl.[4] ..... B26B 19/04

[52] U.S. Cl. ..... 30/346.51; 30/43.97; 76/101 R

[58] Field of Search ..... 30/43.9, 43.91, 43.92, 30/346.51; 76/DIG. 8, 101 R, 101 A, 101 SM; 29/404, 446

[56] References Cited

U.S. PATENT DOCUMENTS

| | | | |
|---|---|---|---|
| 3,092,905 | 6/1963 | Duncan | 30/43.92 |
| 3,390,454 | 7/1968 | Godefroy | 30/346.51 X |
| 3,468,025 | 9/1969 | Messinger | 30/346.51 |
| 3,872,586 | 3/1975 | Oguchi | 30/43.91 |
| 3,973,323 | 8/1976 | Trees . | |
| 4,621,423 | 11/1986 | Schemmann et al. . | |

FOREIGN PATENT DOCUMENTS

| | | | |
|---|---|---|---|
| 171778 | 1/1951 | Austria . | |
| 2228681 | 6/1972 | Fed. Rep. of Germany . | |
| 54-136976 | 10/1979 | Japan . | |
| 0136976 | 10/1979 | Japan | 30/43.92 |
| 7108090 | 12/1972 | Netherlands . | |
| 1392625 | 4/1975 | United Kingdom . | |

*Primary Examiner*—Donald R. Schran
*Assistant Examiner*—Michael D. Folkerts
*Attorney, Agent, or Firm*—Ernestine C. Bartlett

[57] ABSTRACT

A method for making the shaving head of a dry-shaving apparatus with an effective shaving area of a desired shape, in which a shear foil is mounted in an arcuate condition in a shaving-head frame without the cutter so that the foil assumes a free clamping curvature which is not influenced by the cutter, a normal-pressure distribution is applied perpendicular to the foil curvature which simulates the pressure distribution between the cutter and the foil in conformity with a desired effective shaving area, so that the shear foil experiences in said effective shaving area a deformation relative to the free clamping curvature, the simulated pretension curvature thus obtained corresponding to the desired normal-pressure distribution on the cutter in the desired effective shaving area relative to the shear foil.

The cutting edges of the cutter are curved in conformity with the pretension curvature of the shear foil thus determined and the cutter, whose shape is in conformity with said pretension curvature, is pressed into the shear foil with the force which provides the desired normal-pressure distribution.

5 Claims, 2 Drawing Sheets

METHOD FOR MAKING THE SHAVING HEAD OF A DRY-SHAVING APPARATUS

Figure 1:
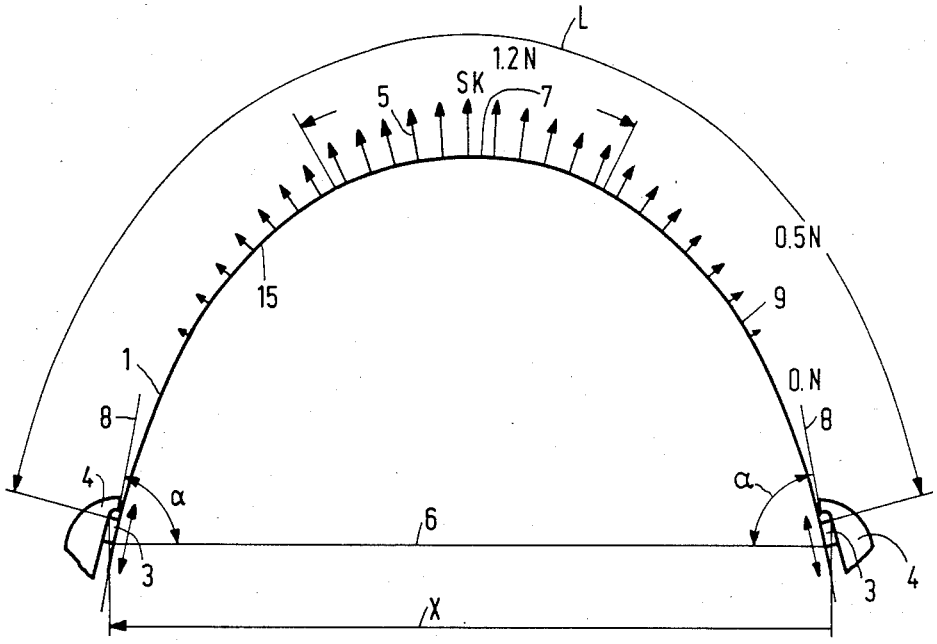

The invention relates to a method for providing the shaving head of a dry-shaving apparatus with an effective shaving area of a desired shape in accordance with its use, in which a shear foil is mounted in an arcuate condition under pretension in a shaving-head frame so as to be movable at the clamping locations, a cutter being pressed into the foil thus curved, which cutter also has curved cutting edges, the tangent lines to the clamping curve at the clamping locations extending at an acute angle to each other towards the apex of the shaving head. The invention also relates to a shaving head manufactured by means of this method.

Shaving heads for dry-shaving apparatus which comprise a clamped-in arcuate foil and a cutter having arcuate cutting edges which are pressed into the arcuate foil are known (see, e.g., Austrian Patentschrift No. 171778). In these known shaving heads the shear foil is forced to adopt the shape of the circularly cylindrical cutter which is urged inwards under spring force, but it is also known to impress an approximately circularly arcuate shape on a shear foil by suitably clamping said foil, so that the shape of said foil changes only slightly when a circular cutter is pressed in. In circularly arcuate shaving heads thus formed it is theoretically possible to obtain a very broad area of contact between the cutter and the foil as a result of the matching circular curvatures. However, in practice clamped-in circularly curved foils even under no-load conditions tend to provide contact mainly on both sides of the apex. The shear foil may be deformed as a result of the shaving force produced during the shaving process, which may give rise to further uncontrolled loss of contact.

Circularly curved shaving heads with a comparatively wide clamping base diameter lead to inadequate stiffness of the shear foil during shaving, in particular in the case of immobile clamping. Any change in shape of the shear foil during shaving changes the contact area between the shear foil and the cutter. During shaving this results in a deterioration in shaving performance.

From DE-OS No. 33 40 661 and corresponding U.S. Pat. No. 4,621,423 it is known to give a shaving head a more slender shape in that both the shear foil and the cutter are curved substantially in accordance with a hyperbolic cosine. Such a shaving head, which requires lower pressures for the cutter, already has a higher foil stiffness, so that larger shaving forces can be handled and an improved contact between the foil and the cutter is obtained. In this case the shear foil is clamped in so as to be movable in such a way that the movability is limited in both directions of movement.

It is the object of the invention to increase the pressure between the cutter and shear foil in the effective shaving area in such a way that in the rest condition forces are produced between the cutter and the shear foil which during shaving sustain the contact between the cutter and the foil in the desired active shaving area.

According to the invention this object is achieved by a method comprising the steps of clamping the shear foil in the frame without the cutter at a pre-selected angle, with a pre-selected length and at a predetermined distance, so that the foil assumes a free clamping curvature which is not influenced by the cutter, applying a normal-pressure distribution perpendicular to the foil curvature when simulated the pressure distribution between the cutter and the foil in conformity with a desired effective shaving area, so that the shear foil experiences in said effective shaving area a deformation relative to the free clamping curvature to produce in the shear foil a simulated pretension curvature, the simulated pretension curvature of the shear foil thus obtained corresponding to the desired normal-pressure distribution on the cutter in the desired effective shaving area relative to the shear foil, forming the cutting edges of a cutter in conformity with said pretension curvature of the shear foil thus simulated, and pressing said cutter having a shape corresponding to said pretension curvature into said shear foil with the force which provides the desired normal-pressure distribution.

In a shaving head of this construction the pretension forces are concentrated in the effective shaving area. By means of such a shaving-head construction the force concentration in the cutter and shear foil is transferred to the desired effective shaving area of the shaving head when said cutter and foil cooperate with each other. This force distribution enhances the shaving performance. The pressure may remain below 4 newtons (N).

The effective shaving area of the shaving head may be selected to be situated in the apex area or beside the apex area, as desired. An effective shaving area in the apex area of the shaving head is preferred for slender shaving heads, because the area to be shaved is better visible in a mirror in the case of the thinner apex portion.

A shaving head manufactured by means of the method in accordance with the invention is characterized in that before the cutter is inserted the line of curvature of the freely clamped shear foil has a larger radius of curvature on both sides of the center of the effective shaving area. Such a construction enables the pretension to be better concentrated in the effective shaving area. At the location where the effective shaving area should be situated the more slender cutter exerts pressure on the shear foil and tensions this foil or tensions it more than in the other shear-foil areas.

The curved shape of the shaving head is primarily determined by preselecting the clamping length, the distance between the clamping points and the clamping angle. In a further embodiment of the invention the curved shape can be influenced further in that the shear foil has a lower resistance to bending in the apex area, which is required to be the effective shaving area, than at the flanks on both sides of the apex area. The different resistance to bending can be utilized to give the shear foil a stronger curvature at the apex than at the flanks, i.e. to obtain a shape which better resembles a wedge shape. The change in resistance to bending can be obtained, for example by a change in cross-section or by the perforation of the foil. In this way the shear foil can assume a more wedge-shaped form in its freely clamped condition. In the effective shaving area the normal pressure between the cutter and the shear foil required for shaving must be obtained by giving the cutter a suitable shape using the simulation method described above. A more wedge-shaped shaving-head construction provides a better adaptation to the skin contour and a better visibility of the skin area just shaved.

In a further embodiment of the invention, in order to obtain a pointed shaving-head apex, the clamping height between the foil clamping locations and the apex is 18 to 30 mm when the clamping-basewidth of the shear foil is 12 to 20 mm. In this way the inventive method yields shaving heads with shear foils which for different widths in the effective shaving area all produce forces between the cutter and the shear foil which are larger than the shaving forces, which tend to lift the shear foil during shaving.

Figure 2:
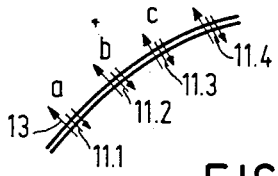
Figure 3:
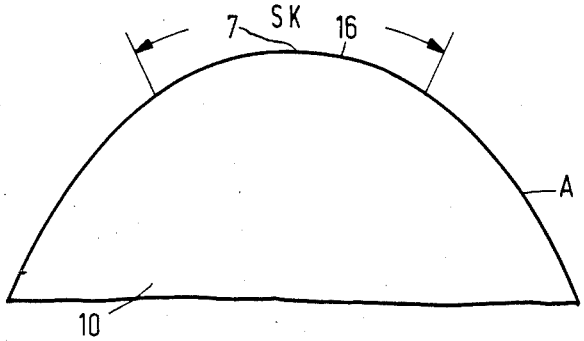
Figure 4:
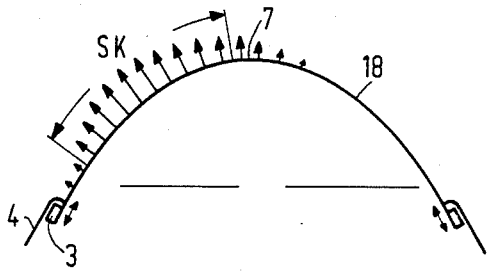
Figure 5:
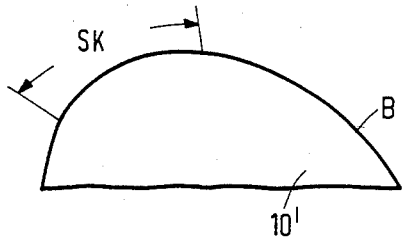
Figure 6:
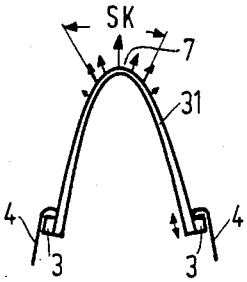
Figure 7:
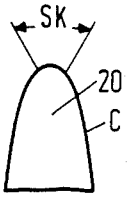

Embodiments of the invention will now be described in more detail, by way of example, with reference to the accompanying drawings. In the drawings:

FIG. 1 shows a freely clamped shear foil without cutter to which a desired shaving load is applied (simulated), the shaving load being represented by the arrows, FIG. 2 is a sectional view showing the curvature of a part of the shear foil which, in theory, is divided into a multitude of separate portions, FIG. 3 shows a cutter having the shape of the pretension curvature in the case of a desired pressure distribution on the shear foil having an effective shaving areas at the apex of the shaving head, FIG. 4 illustrates the clamping curvature in the case of a freely clamped shear foil having a preferred effective shaving area at a flank of the shaving head, FIG. 5, in the same way as in FIG. 4, shows a cutter with the pretension curvature, obtained by simulation, for a shear foil having an effective shaving area at one flank of the shaving head, FIG. 6 shows a clamped-in very slender wedge-shaped shear foil with a low resistance to bending, and FIG. 7 shows a cutter with the pretension curvature of the shear foil of FIG. 6 determined by simulation.

FIG. 1 shows a shear foil 1 of a dry-shaving apparatus, which foil is mounted in its unloaded condition in a shaving-head frame 4 so as to be longitudinally movable at clamping locations 3. The tangent lines to the shear foil at the clamping locations extend towards the apex at an acute angle $\alpha$ to the shaving head base 6. The distance between the clamping locations 3 is designated X. The clamping length of the shear foil is L. In this way the shear foil is given a natural curvature which resembles the desired curvature as closely as possible. In order to obtain in the effective shaving area SK a force distribution which precludes loss of contact both under no-load and loaded conditions, the shear foil is subjected to a normal-pressure load which corresponds to the desired normal-pressure load exerted by the cutter in the rest condition and which is required to be larger than the lifting forces occurring during shaving. In FIG. 1 this preferred load is indicated by the arrows 5. The arrows 5 in the direct proximity of the apex 7 should correspond to a pressure of approximately 1.2N and should correspond to pressures decreasing from 0.5N to 0N towards the flanks 9.

FIG. 2 illustrates how the pressure load is simulated. FIG. 2 is a sectional view showing only a part of the foil, i.e. a curved portion of the foil. In order to simulate the foil deformation obtained in the case of the selected foil load, the part 11 of the foil in FIG. 2 is divided into very small portions a, b, c etc. in accordance with the finite-element method. The forces acting on the foil are applied at each dividing line 11.1, 11.2, 11.3, 11.4. These forces are indicated by arrows 13. The length of the arrows 13 indicates the desired pressure distribution, as is shown in FIG. 1. On the basis of this pressure distribution it is then possible to determine a pretension curvature. If the cutting edges 16 of the cutter 10 are given the pretension curvature thus determined, the shear foil in conjunction with the cutter 10 thus shaped guarantees the required pressure forces in the effective shaving area SK, for example at the apex in FIG. 1. In FIG. 3 the concentration of forces in the effective shaving area is transferred to the apex. The curvature A of the cutter 10, corresponding to the pretension curvature of the foil and shown in FIG. 3 then has a more slender cutting-edge contour than the foil shown in FIG. 1 in the rest condition without cutter.

This shape of the shaving head determined by simulation can be adapted to meet specific requirements in conformity with the desired effective shaving area. FIG. 4 shows an embodiment in which the effective shaving area SK is situated at a flank. In the same way as in the simulation in accordance with FIG. 2 a suitable force distribution is applied to the shear foil 18. This simulated force distribution on the shear foil results in a pretension curvature of the shape B for the shear foil 18, the cutting-edge contour of the cutter 10' also having this shape (FIG. 5)

FIG. 6 shows a further embodiment in which the shear foil 31 is more flexible at the apex 7. As a result of this, the foil 31, which is clamped in so as to be freely movable between the clamping locations 3, can adopt a more wedge-shaped curvature when it is not loaded. If again a simulated load is applied as indicated by the arrows in FIG. 6, a simulated pretension curvature is obtained. This pretension curvature again corresponds to the shape of the cutting-edge contour C of the cutter 20 shown in FIG. 7.

The higher flexibility of the shear foil 31 at the location of the apex 7 can be influenced by varying the thickness of the foil, the width and number of connecting portions between the apertures, and the shape and number of apertures.

The shape of the shaving head depends on the desired specification of the relevant apparatus and the requirements imposed by the manufacturer of the apparatus. The curvature of the foil and the cutter may be a curvature in accordance with a hyperbolic cosine, an elliptical curvature or a parabolic curvature. Intermediate values are also conceivable. The principle underlying the invention resides in the stiffness of the effective shaving area SK obtained by means of the corresponding shear-foil and cutter curvatures.

The method enables the manufacturer or designer to select the shape of the shaving heads freely and as desired and thus to sustain the contact between the shear foil and cutter in the desired effective shaving area during shaving, which results in a good shaving performance. The well-known lifting effects, which reduce the shaving performance, occur no longer.

What is claimed is:

1. A method for providing the shaving head of a dry-shaving apparatus with an effective shaving area of a desired shape in accordance with its use, said shaving head comprising a base, as having head frame, a shear foil and a cutter, comprising the steps of clamping the shear foil in the frame between clamping locations without the cutter at a pre-selected angle said angle being the angle formed between the shaving head base and tangent lines to the shear foil at the clamping locations that extend toward the apex of the shaving head, with a pre-selected length of the shear foil between the clamping locations and at a predetermined distance between the clamping locations so that said foil assumes a free clamping curvature which is not influenced by the cutter, applying a normal pressure distribution perpendicular to the foil curvature which simulates the pressure distribution between the cutter and the foil in conformity with a desired effective shaving area, so that the shear foil experiences in said effective shaving area a deformation relative to the free clamping curvature to produce in the shear foil a simulated pretension curvature, the simulated pretension curvature of the shear foil thus obtained corresponding to the desired effective shaving area relative to the shear foil, forming the cutting edges of a cutter in conformity with said pretension curvature of the shear foil thus simulated, and pressing said cutter having a shape corresponding to said pretension curvature into said shear foil with the force which provides the desired normal-pressure distribution.

2. The method as claimed in claim 1 wherein the effective shaving area is situated at the apex area of the shaving head.

3. The method as claimed in claim 1, characterized in the effective shaving area is situated at a flank of the shaving head.

4. A shaving head for a dry-shaving apparatus, manufactured by means of the method as claimed in claim 1, characterized in that before the cutter is inserted the line of curvature of the freely clamped-in shear foil has a larger radius of curvature than the cutter and after insertion the cutter completely engages against the foil in the simulated area and the cutted adopts the simulated pretension curvature.

5. A shaving head manufactured by means of the method as claimed in claim 1, characterized in that the shear foil has a lower resistance to bending in the apex area, which is required to be the effective shaving area, than at the flanks on both sides of the apex area.

* * * * *